US006808429B2

(12) United States Patent
Takada et al.

(10) Patent No.: US 6,808,429 B2
(45) Date of Patent: Oct. 26, 2004

(54) CONNECTOR AND A CONNECTOR ASSEMBLY

(75) Inventors: Kiyokazu Takada, Yokkaichi (JP); Hiroshi Nakano, Yokkaichi (JP); Atsushi Nishida, Toyota (JP); Masato Minakata, Toyota (JP); Keiichi Itou, Toyota (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/774,009

(22) Filed: Feb. 6, 2004

(65) Prior Publication Data

US 2004/0171316 A1 Sep. 2, 2004

(30) Foreign Application Priority Data

Feb. 10, 2003 (JP) ..... 2003-032451

(51) Int. Cl.[7] ..... H01R 13/514
(52) U.S. Cl. ..... 439/752; 439/489
(58) Field of Search ..... 439/752, 489

(56) References Cited

U.S. PATENT DOCUMENTS

| | | | | |
|---|---|---|---|---|
| 5,860,822 A | * | 1/1999 | Nishide et al. | 439/752 |
| 5,980,331 A | * | 11/1999 | Matsushita et al. | 439/752 |
| 6,086,431 A | | 7/2000 | Konoya et al. | 439/752 |
| 6,146,214 A | | 11/2000 | Konoya et al. | 439/752 |
| 6,264,497 B1 | * | 7/2001 | Murakami et al. | 439/752 |

* cited by examiner

*Primary Examiner*—Tho D. Ta
(74) *Attorney, Agent, or Firm*—Gerald E. Hespos; Anthony J. Casella

(57) ABSTRACT

A connector (10) has a holder (11), auxiliary connectors (60) and a retainer (34). The retainer (34) has slanted surfaces (38A) and a vertical wall (39A). The slanted surfaces (38A) engage an opening-end surface (57A) of a mating connector (50) to guide the retainer (34) into a proper position if the auxiliary connectors (60) are inserted to proper positions. However the vertical wall (39A) contacts the opening-end surface (57A) if the auxiliary connectors (60) are not pushed to the proper positions. Thus, the fitting operation cannot be completed and the improperly inserted auxiliary connector (60) is detected.

10 Claims, 22 Drawing Sheets

CONNECTOR AND A CONNECTOR ASSEMBLY

BACKGROUND OF THE INVENTION

1. Field of the Invention

The invention relates to a connector with a retainer and to a connector assembly.

2. Description of the Related Art

U.S. Pat. No. 6,086,431 and U.S. Pat. No. 6,146,214 disclose a connector with a housing configured for receiving terminals. Locks are formed in the housing for locking the terminals. A retainer mount hole is formed in one side surface of the housing and receives a retainer for doubly locking the terminals in the housing. The properly mounted retainer is flush with the housing, and can be accommodated with the housing in a receptacle of a mating connector.

A terminal that is not inserted completely into the housing will interfere with the retainer. Thus, the retainer cannot be pushed into the retainer mount hole and is raised slightly from the housing if a terminal is left partly inserted into the connector housing. Accordingly, the retainer prevents the housing from being inserted into the receptacle of the mating housing. An attempt could be made to fit the housing into the receptacle of the mating connector in this state. However, such a fitting operation is hindered by interference of the retainer and the receptacle. As a result, partial insertion of a terminal can be detected.

The retainer may be pushed insufficiently into the retainer mount hole even though the terminal has been pushed to a proper depth. In this situation, the ends of the retainer may be raised slightly from the housing. The housing and the mating housing may be configured to push the retainer automatically into the retainer mount hole as the housing is fitted into the receptacle. More particularly, a part of the retainer facing the receptacle may have a slanted surface aligned for sliding contact with the receptacle for guiding the retainer into the retainer mount hole.

The slanted surface of the retainer may deform the receptacle if a strong force is exerted when a terminal is inserted only partly. As a result the housing may be fit into the receptacle while the retainer is slightly raised therefrom.

The invention was developed in view of the above problems, and an object thereof is to prevent a housing from being fitted into a receptacle of a mating connector when a terminal fitting is left partly inserted while being provided with a guiding function of guiding a retainer into a retainer mount hole.

SUMMARY OF THE INVENTION

The invention relates to a connector for receiving at least one terminal fitting. The connector has an engageable element that fits into a receptacle on a mating connector. The connector also has an accommodating portion that is configured to receive a retainer. The retainer and the engageable element can be fit in the receptacle when the engageable element is accommodated properly in the accommodating portion. However, the retainer contacts an opening edge of the receptacle when the retainer is inserted improperly in the accommodating portion. The retainer has at least one slanted guide surface configured for sliding contact with the opening edge of the receptacle to guide the retainer into the accommodating portion. The retainer also has at least one restriction wall that faces the opening of the receptacle.

The restriction wall preferably is between a start and an end of the slanted surface with respect to the fitting direction of the engageable element and preferably is inward from the slanted surfaces.

The restriction wall contacts the open-end of the receptacle during the fitting operation, and hence limits the fitting operation.

The accommodating portion preferably is formed by recessing a side surface of the engageable element.

An attempt may be made to fit the engageable element into the receptacle while the retainer is left only partly inserted. However, the guide of the retainer contacts the opening edge of the receptacle during the fitting operation. Thereafter, the slanted surfaces guide the retainer into the accommodating portion, and both the engageable element and the retainer are accommodated in the receptacle when the fitting operation is completed.

The guide of the retainer could be squashed during the fitting operation if, for example, the engageable element is urged into the receptacle even though the terminal fitting is not pushed to a proper depth in the engageable element. In such a case, a part of the retainer contacts the terminal fitting, and the retainer cannot be pushed into the accommodating portion. Accordingly, the guide could contact the opening edge of the receptacle and deform if the retainer is pushed forcibly in such a circumstance. However, the restriction wall contacts the opening-end surface of the receptacle to prevent the fitting operation of the connector into the receptacle.

The engageable element preferably has auxiliary connectors and a holder into which the auxiliary connectors are mountable.

The retainer preferably has guide walls at the opposite sides of a main portion thereof. The guide walls are disposed to slide in contact with side surfaces of the holder. The retainer has a U-shape and crosses over the holder and locks the auxiliary connectors inserted to a proper depth in the holder when the retainer is accommodated properly in the accommodating portion.

Each guiding wall of the retainer preferably has an extending portion that extends toward the receptacle and projects out from the accommodating portion when the retainer is inserted only partly. The guide is formed on the extending portion.

The guiding walls slide in contact with the side surfaces of the holder and hold the retainer on the holder. Each guiding wall has the extending portion formed with the guide. Thus, the guides are formed on existing structures, and the shape of the retainer is not complicated by the guides.

At least one guiding groove preferably is formed in an inner surface of the receptacle of the mating connector and extends substantially in the fitting direction. At least one guiding rib projects from a side surface of the holder and is engageable with the guiding groove.

The retainer preferably locks the properly inserted auxiliary connectors in the holder when the retainer is accommodated properly in the accommodating portion. The outer surface of the retainer has at least one protruding piece to become substantially flush with the guiding rib. The guide is formed at a leading end of the protruding piece with respect to the fitting direction. Accordingly, the protruding piece is inserted into the guiding groove together with the guide rib when the engageable element is fit into the receptacle to define a guide during the fitting operation. The guide is formed on an existing structure and does not complicate the shape of the retainer.

The invention also relates to connector assembly comprising the above-described connector and a mating connector connectable therewith.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

An embodiment of the invention is described with reference to FIGS. 1 to 22, and includes first and second connectors 10 and 50 respectively that are connectable with one another. In the following description, sides of the two connectors 10, 50 to be connected with each other are referred to as the front.

Figure 1:
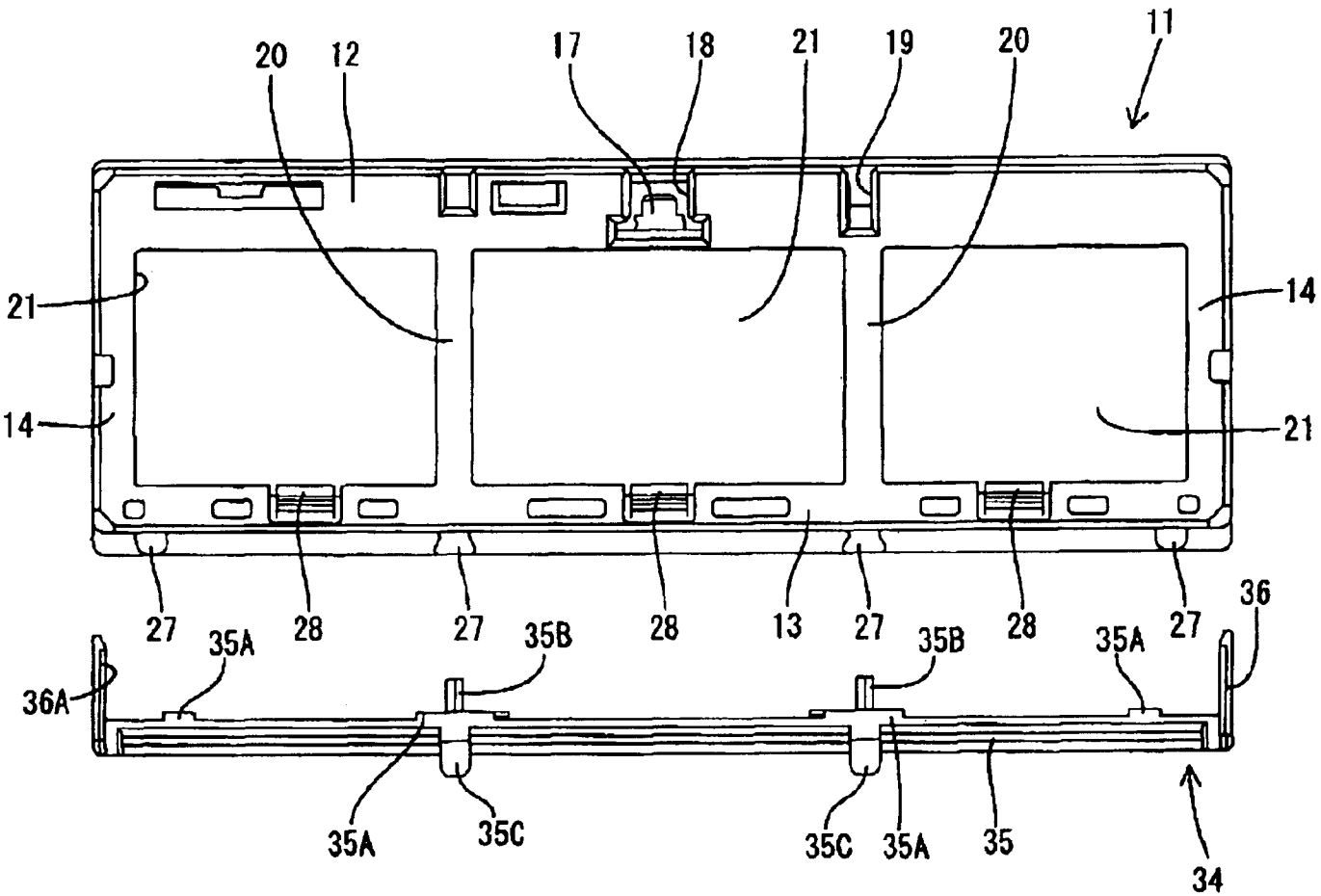
FIG. 1 is a front view of a holder and a housing retainer according to one embodiment of the invention.
Figure 2:
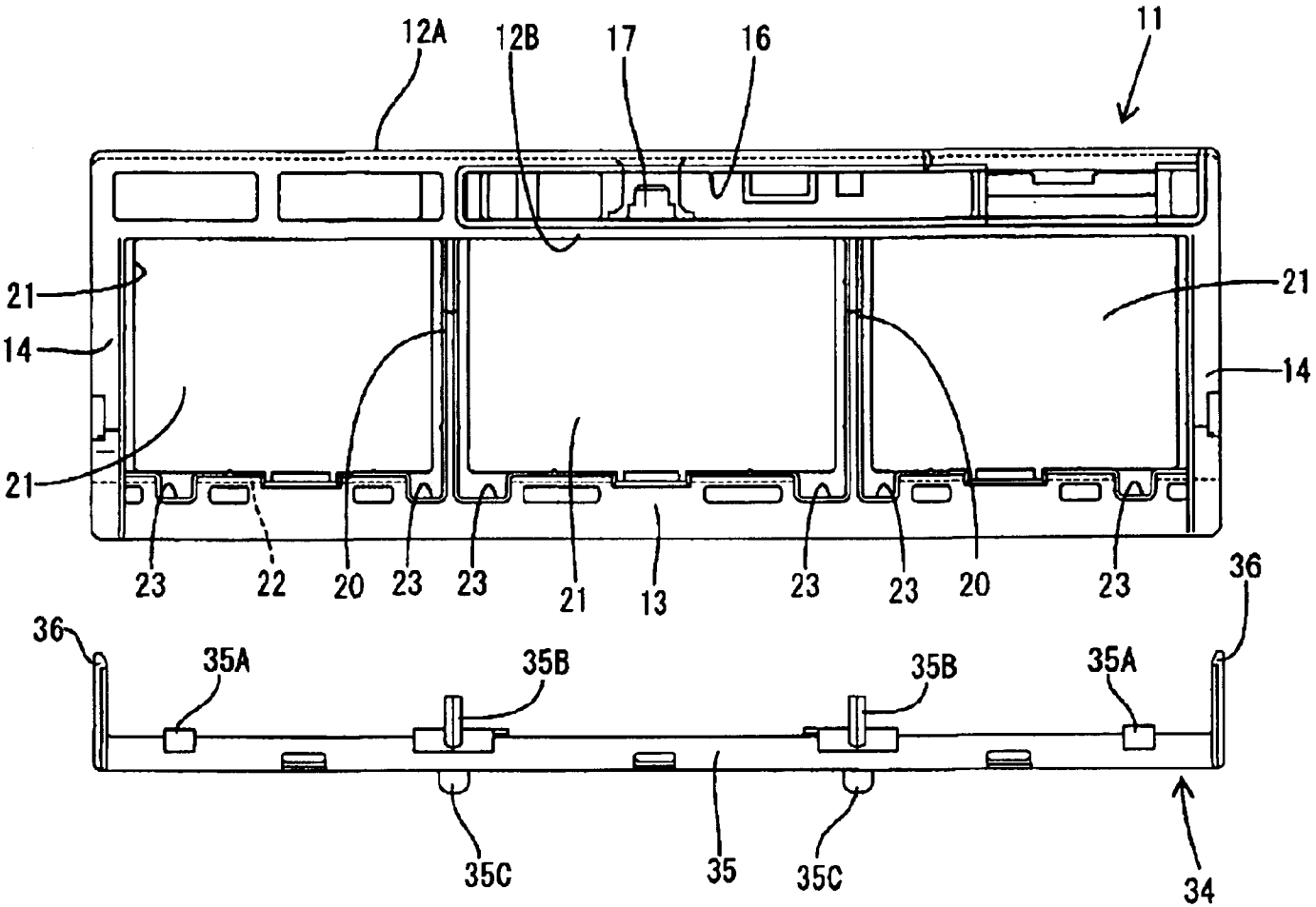
FIG. 2 is a rear view of the holder and the housing retainer.

The first connector 10 includes a holder 11 that is made e.g. of a synthetic resin. The holder 11 defines a wide frame that is hollow in forward and backward directions, as shown in FIGS. 1 and 2. Partition walls 20 extend between an upper wall 12 and a bottom wall 13 of the holder 11 to define transversely arranged mount spaces 21.

Figure 4:
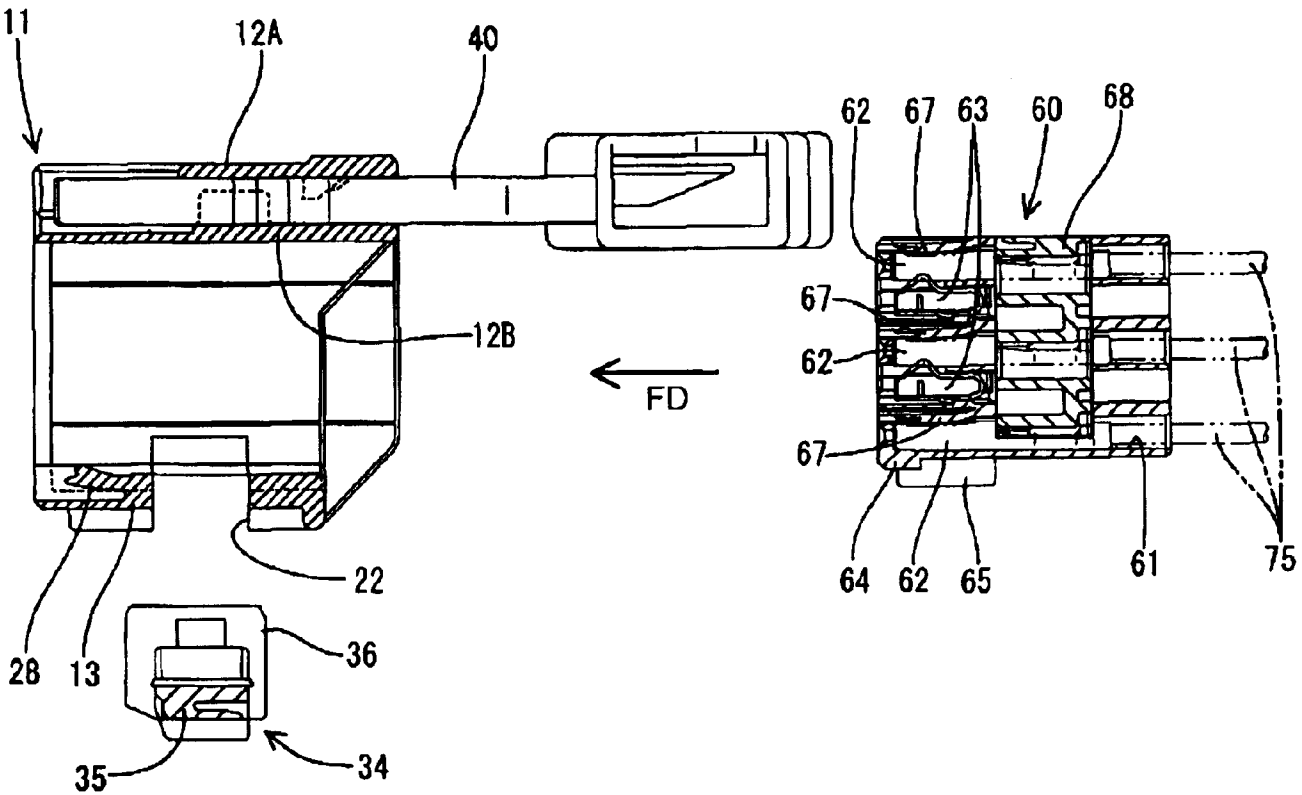
FIG. 4 is a longitudinal section showing a state before an auxiliary connector is mounted into the holder.
Figure 5:
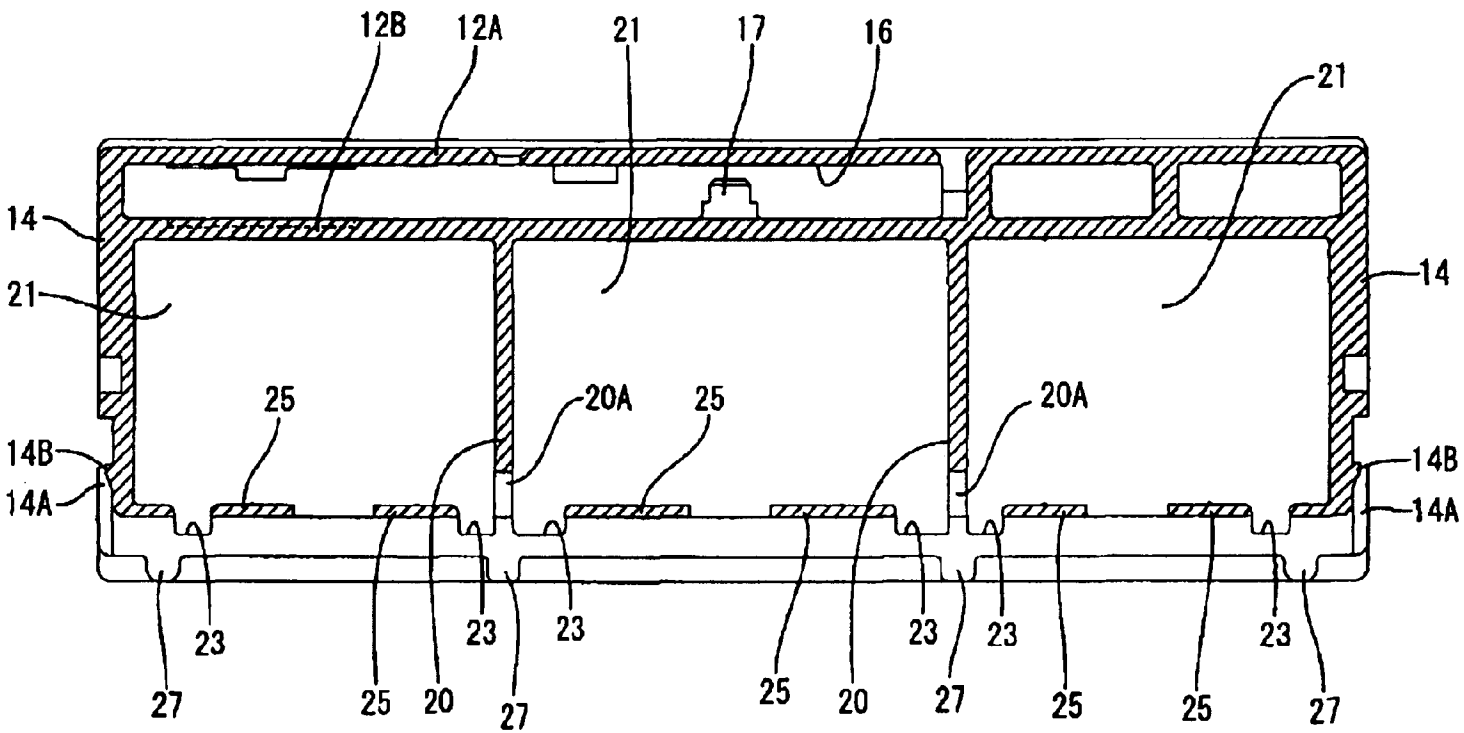
FIG. 5 is a lateral section of the holder.

The first connector 10 also includes auxiliary connectors 60 that can be fit into the corresponding mount spaces 21 from behind. The auxiliary connectors 60 are substantially rectangular blocks and have basically the same construction. However, the auxiliary connector 60 to be inserted into the middle mount space 21 is wider than those inserted into the left and right mount spaces 21. Cavities 61 are formed in each auxiliary connector 60 as shown in FIG. 4. A female terminal fitting 62 is inserted into each cavity 61 from behind, and a wire 75 to be secured to the female terminal fitting 62 is drawn out to the back through the rear surface of the auxiliary connector 60. Each female terminal fitting 62 is locked in the cavity 61 by a lock 67 at the upper wall of the cavity 61. A retainer mount hole is formed in the bottom surface of each auxiliary connector 60 over substantially the entire width of the frame 11, so that a terminal retainer 68 can be accommodated therein. The terminal retainer 68 is designed to lock the female terminal fittings 62 redundantly to prevent the female terminals 62 from coming out of the auxiliary connectors 60.

Shorting terminals 63 are inserted into the cavities 61 from the front of the auxiliary connectors 60. The shorting terminals 63 are adapted to short at least some of the transversely arranged female terminals 62 with each other until the first connector 10 is fit into the second connector 50. The back surface of the receptacle 53 of the second connector 50 has substantially forward-projecting disengaging pieces 69 at positions corresponding to the shorting terminals 63. Thus, upon connecting the two connectors 10, 50, the disengaging pieces 69 enter between the shorting terminals 63 and the female terminal fittings 62 to deform contact portions of the shorting terminals 63 away from the female terminal fittings 62, thereby separating the shorting terminals 63 from the female terminal fittings 62 to cancel the shorted state.

Substantially parallel detection ribs 65 extend forward and backward on the bottom surface of each auxiliary connector 60 at asymmetrical positions near the left and right sides of each auxiliary connector 60. Detection grooves 23 are formed on the bottom wall 13 of the holder 11 at positions corresponding to the detection ribs 65 of the respective auxiliary connectors 60. The detection grooves 23 extend back from the front side and are dimensioned to receive the detection ribs 65. The detection ribs 65 guide the auxiliary connectors 60 into the holder 11, hinder erroneous insertion (front-side back, upside-down insertion) of the auxiliary connectors 60 into the holder 11 and detect an insufficiently pushed state of the auxiliary connectors 60 into the holder 11.

A lock 64 projects down from a front middle position of the bottom surface of each auxiliary connector 60. On the other hand, a locking piece 28 is formed at the front side of the bottom wall 13 of the holder 11 for each mount space 21 and is resiliently engageable with the lock 64. The lock 64 is engaged with the corresponding locking piece 28 when the auxiliary connector 60 is inserted substantially to a proper depth to prevent the auxiliary connector 60 from coming out of the holder 11. Additionally, the front surfaces of the holder 11 and the auxiliary connector 60 are substantially flush with each other when the auxiliary connector 60 is inserted substantially to the proper depth.

Figure 3:
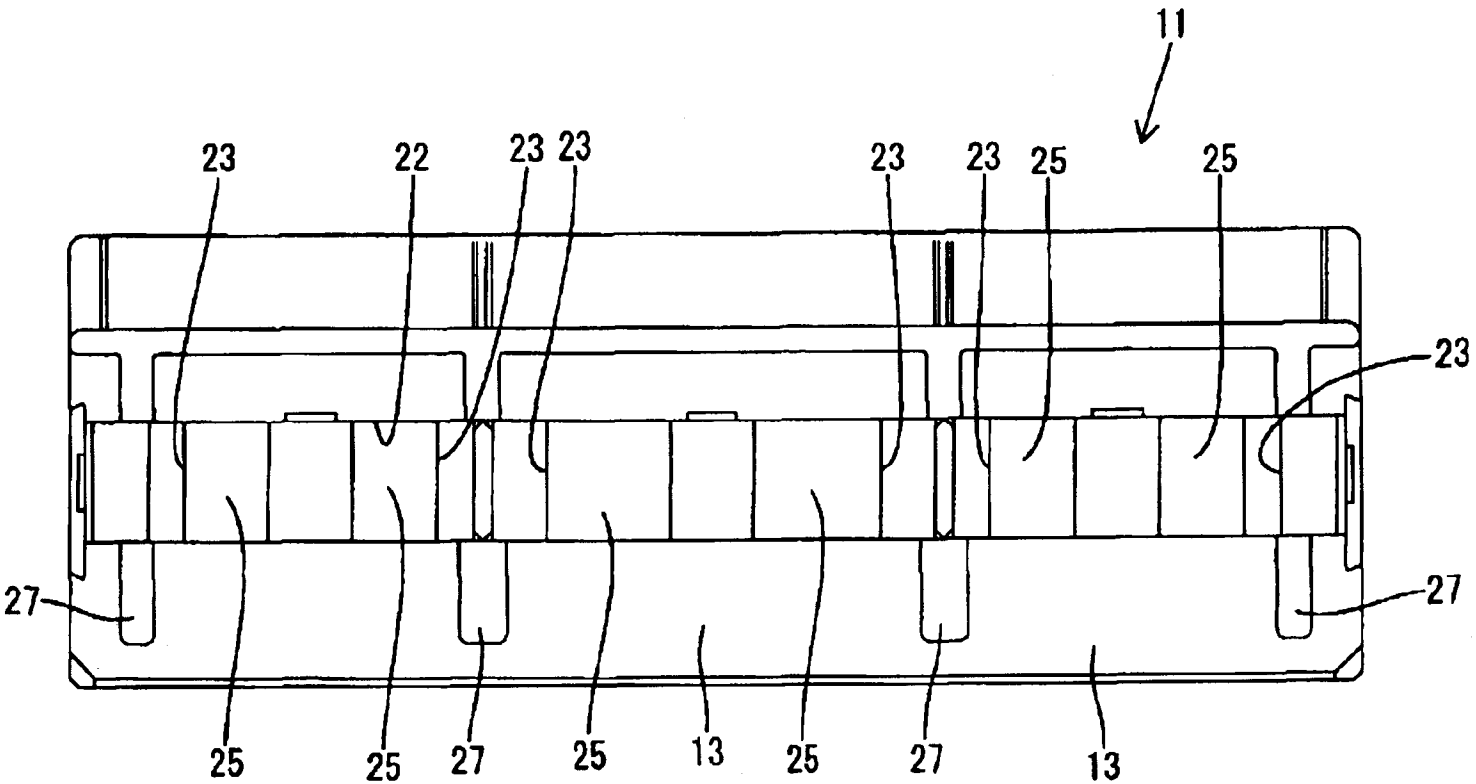
FIG. 3 is a bottom view of the holder.

The lower surface of the bottom wall 13 of the holder 11 is recessed at a substantially middle position and extends over substantially the entire width of the holder 11, as shown in FIG. 3. Two coupling plates 25 bridge the front and rear sides of the accommodating portion 22 at each mount space 21 to reinforce the holder 11, and detection grooves 23 are formed at the outer sides of the coupling plates 25. The accommodating portion 22 substantially communicates with the mount spaces 21 via the detection grooves 23.

The front end of the accommodating portion 22 aligns substantially with the rear ends of the detection ribs 65 when the auxiliary connectors 60 are inserted to the proper depth.

The housing retainer 34 is made e.g. of a synthetic resin and has a substantially plate-shaped a main portion 35 that is substantially as wide as the holder 11. Guiding walls 36 project up at the opposite widthwise ends of the main portion 35. Thus, the housing retainer 34 has a U-shaped cross section. The guiding walls 36 are movable along side walls 14 of the holder 11. Locking projections 35A are provided on the upper surface of the main portion 35. The locking projections 35A are at positions corresponding to the detection grooves 23 of the holder 11 and are dimensioned to enter the detection grooves 23. Intermediate walls 35B project up at positions on the upper surface of the main portion 35 substantially corresponding to the partition wails 20.

Figure 6:
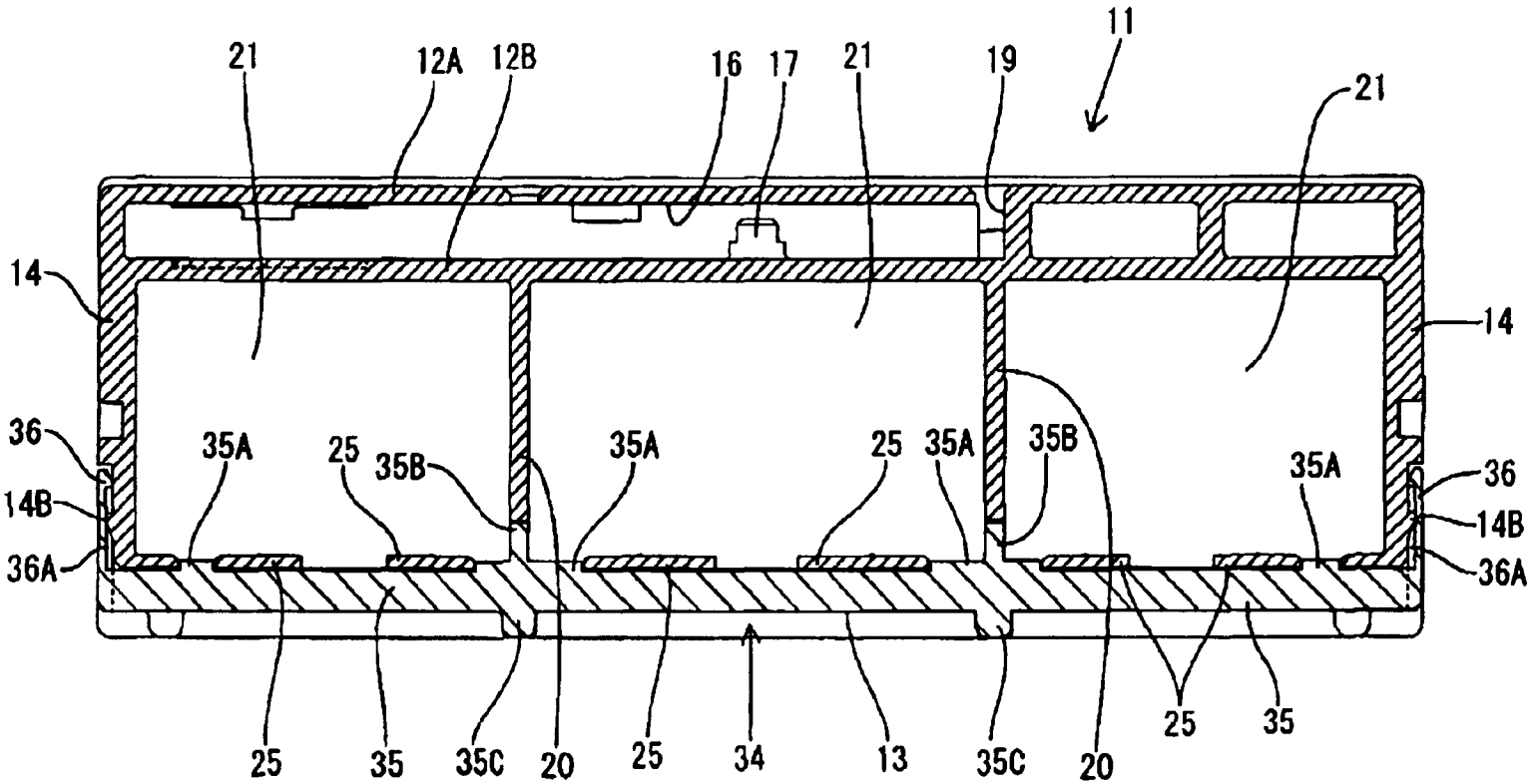
FIG. 6 is a lateral section showing the housing retainer accommodated in the holder.
Figure 7:
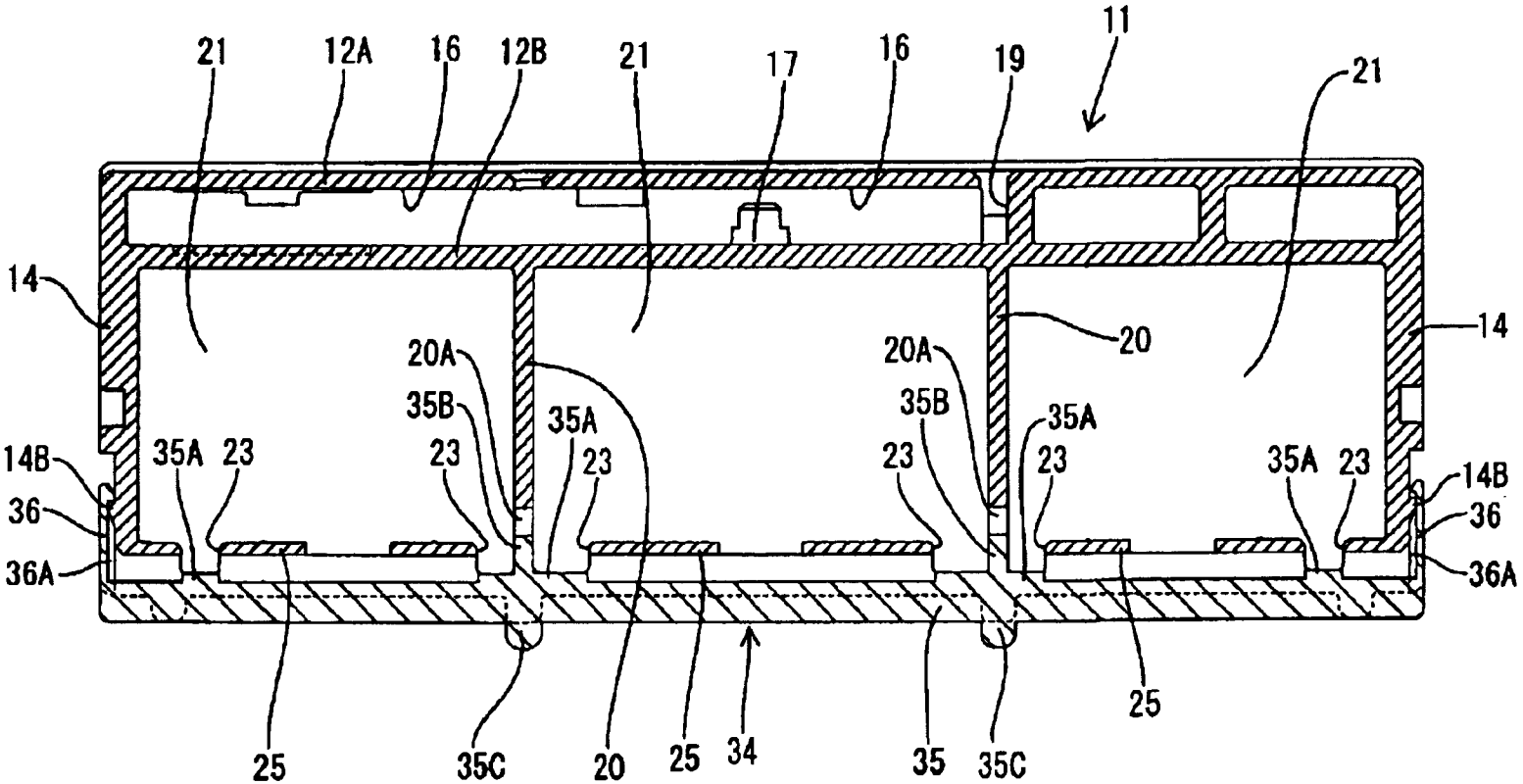
FIG. 7 is a lateral section showing the housing retainer projecting from the holder.

The main portion 35 of the housing retainer 34 can be pushed into the accommodating portion 22 and stops after contacting the wall surface of the accommodating portion 22. In this accommodated position, the main portion 35 is substantially flush with the holder 11, as shown in FIG. 6. The locking projections 35A of the housing retainer 34 project through the detection grooves 23 and into the mount spaces 21 when the housing retainer 34 is inserted to the accommodated position. Thus, the locking projections 35A engage the rear ends of the detection ribs 65 to prevent the auxiliary connectors 60 from coming out backward. Further, engaging grooves 20A are formed at the bottom parts of the partition walls 20 of the holder 11 and communicate with the accommodating portion 22. The intermediate walls 35B of the housing retainer 34 enter the engaging grooves 20A at the accommodated position and hold the middle auxiliary connector 60 therebetween. In this way, the housing retainer 34 is prevented from shaking along the widthwise direction. It should be noted that any special locking mechanism is provided between the accommodating portion 22 and the housing retainer 34 at the accommodated position.

The detection ribs 65 of the auxiliary connector 60 are in the accommodating portion 22 if the auxiliary connector 60 is not inserted-to the proper depth in the holder 11. Thus, the housing retainer 34 cannot reach the accommodated position due to interference between the locking projections 35A and the detection ribs 65. This enables a detection of the insufficiently pushed state of the auxiliary connector 60 into the holder 11.

The housing retainer 34 can be displaced from the accommodated position to a projecting position (see FIG. 7) where the main portion 35 projects out from the outer surface of the holder 11. Specifically, guiding recesses 14A are formed at opposite sides of the accommodating portion 22 and have substantially the same depth as the holder 11 (see FIG. 5). The guiding recesses 14A guide movements of the housing retainer 34. Projections 14B are formed on the side surfaces of the guiding recesses 14A, and locking grooves 36A are formed in the inner side surfaces of the guiding walls 36 for engaging the locking projections 14B. The ends of the locking grooves 36A of the housing retainer 34 engage the projections 14B to lock the housing retainer 34 in the holder 11 when the housing retainer 34 reaches the projecting position. The locking projections 35A are retracted below the detection grooves 23 of the holder 11 at the projecting position. Thus, the auxiliary connectors 60 can be inserted into and withdrawn from the holder 11 without interference.

The upper wall 12 of the holder 11 is comprised of an upper plate 12A and a ceiling plate 12B, and a wide accommodating section 16 is defined between the opposing surfaces of the upper plate 12A and the ceiling plate 12B. A supporting shaft 17 projects up from the ceiling plate 12B toward the upper plate 12A in substantially the middle of the accommodating section 16.

Figure 8:
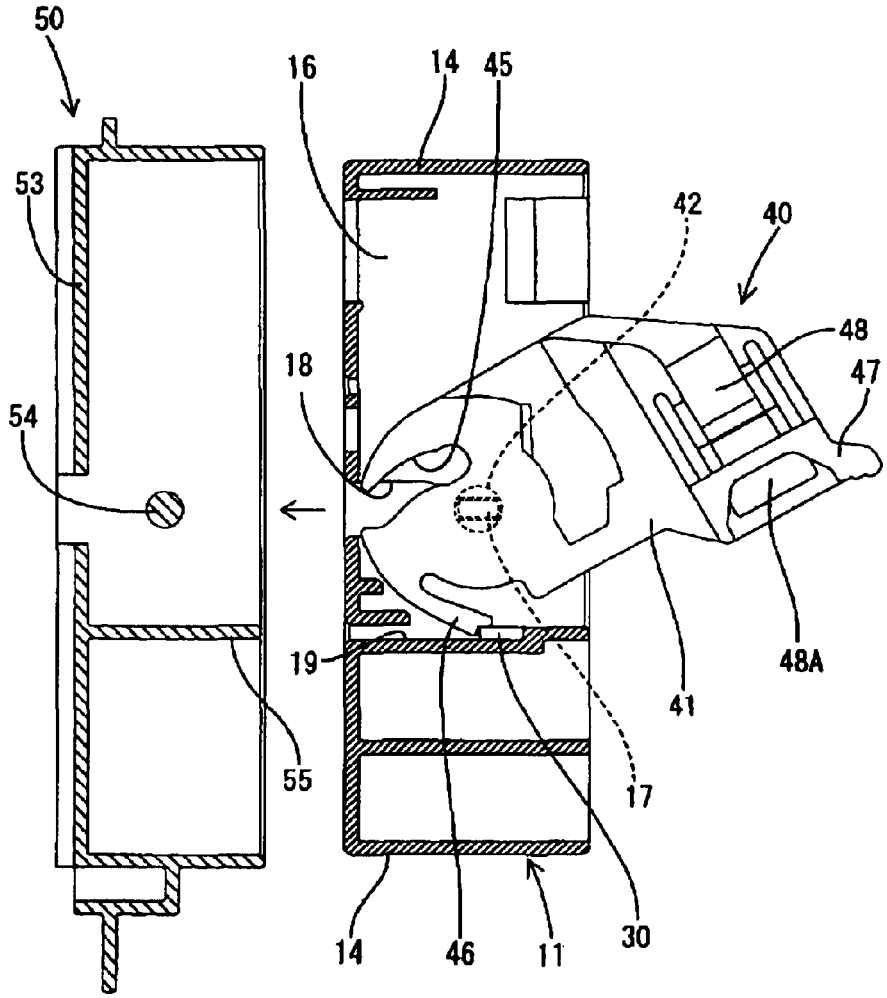
FIG. 8 is a horizontal section showing a state before a first and a second connectors are connected.
Figure 9:
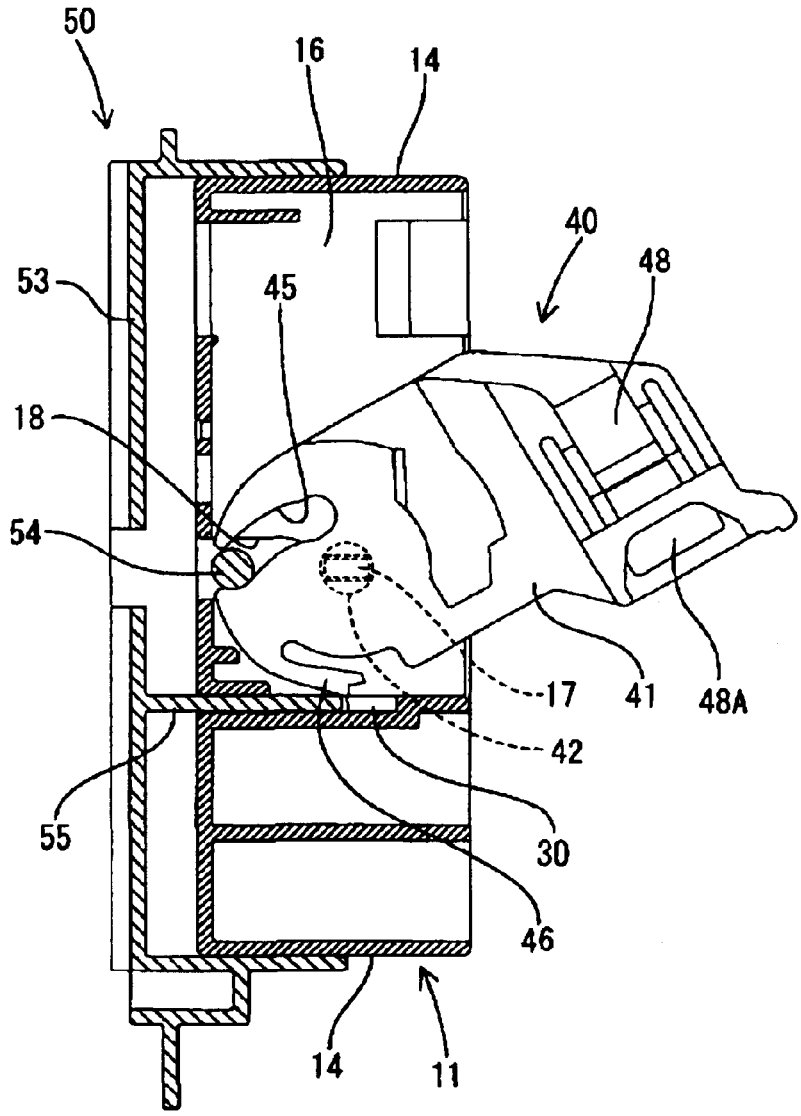
FIG. 9 is a horizontal section showing an intermediate stage of the connection of the first and second connectors.
Figure 10:
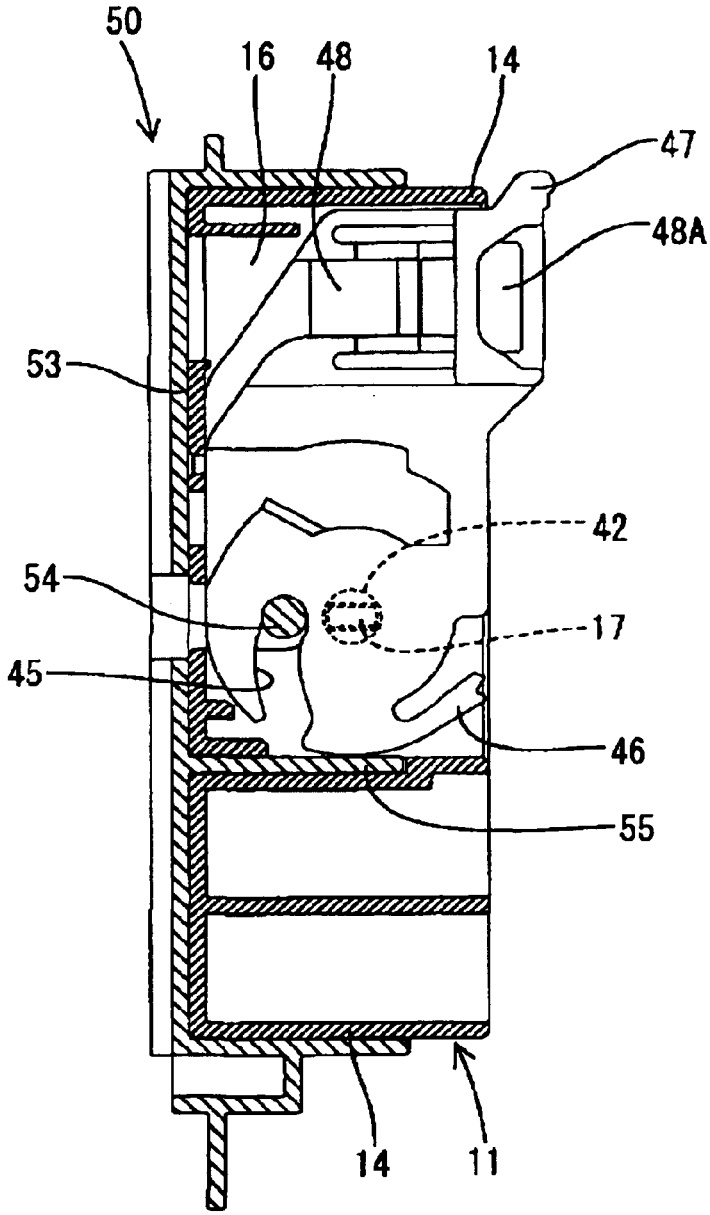
FIG. 10 is a horizontal section showing a state where the connection of the first and second connectors is completed.

A plate-shaped lever 40 is disposed in the accommodating section 16 of the upper wall 12. The lever 40 is made e.g. of a synthetic resin, and includes a long narrow cam plate 41. A round bearing hole 42 is formed in the lower surface near one end of the cam plate 41 and the supporting shaft 17 of the holder 11 is engaged with the bearing hole 42. Thus, the lever 40 is rotatable about the supporting shaft 17 between an initial position where a rear side of the lever 40 projects from the holder 11, as shown in FIG. 8, and a connection ending position where the lever 40 is accommodated substantially completely in the holder 11, as shown in FIG. 10.

A cam groove 45 is formed around the bearing hole 42 of the cam plate 41 and is open at the edge of the cam plate 41. On the other hand, an escape groove 18 is formed in the upper plate 12A of the holder 11 before the supporting shaft 17. An opening 45A of the cam groove 45 aligns with the escape groove 18 when the lever 40 is at the initial position.

A resilient locking piece 46 is cantilevered substantially in the plane of the cam plate 41 and bulges out radially at an end of the cam plate 41 near the bearing hole 42. On the other hand, a narrow engaging block 30 is formed on the ceiling plate 12B transversely of the supporting shaft 17. The resilient locking piece 46 engages an end of the engaging block 30 when the lever 40 is at the initial position to prevent the lever 40 from rotating toward the connection ending position. An insertion groove 19 is formed in the upper plate 12A and extends from the front surface of the holder 11 toward the engaging portion 30. On the other hand, the second connector 50 has an unlocking rib 55 that can enter the insertion groove 19. Thus, in the process of connecting the two connectors 10, 50, the unlocking rib 55 at least partly enters the insertion groove 19 to displace the resilient locking piece 46 in unlocking direction, whereby the engaging portion 30 is freed from its locked state.

An operable portion 47 is formed at the end of the cam plate 41 opposite the bearing hole 42 and is at the rear side when the lever 40 is at the connection ending position. A resilient locking piece 48 is at a surface of the operable portion 47 facing the upper plate 12A and is deformable in a direction substantially normal to the cam plate 41 (i.e. to plane of FIG. 8). On the other hand, the upper wall 12 of the holder 11 has a claw (not shown) that is engageable with the resilient locking piece 48 to hold the lever 40 at the connection ending position. A flat plate-shaped finger-pushable portion 48A is formed at the leading end of the resilient locking piece 48. Thus, a locked state of the lever 40 by the claw can be canceled by pushing the finger-pushable portion 48A substantially normal to the cam plate 41 (i.e. to plane of FIG. 8).

Figure 11:
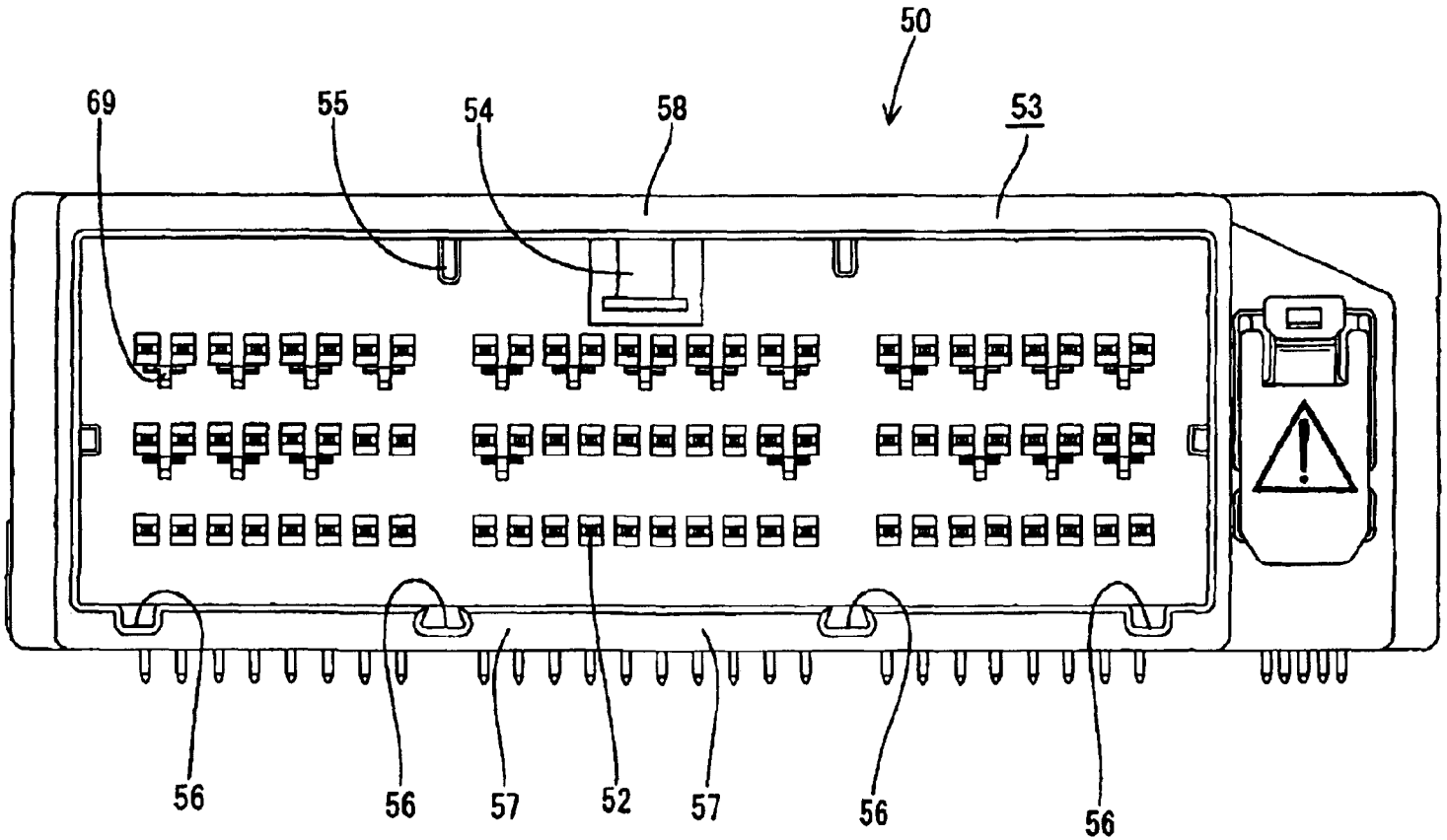
FIG. 11 is a front view of the second connector.
Figure 12:
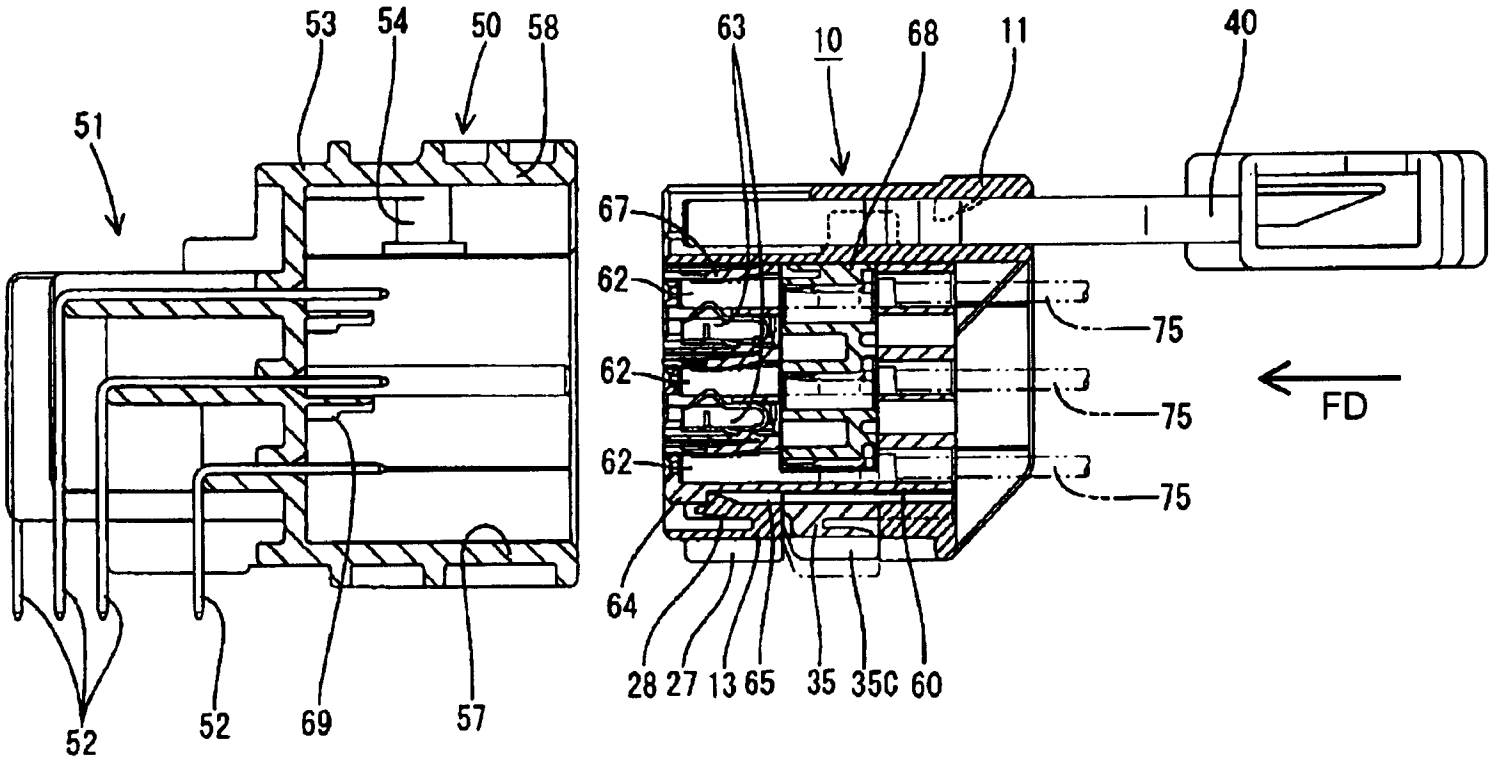
FIG. 12 is a longitudinal section showing the state before the first and second connectors are connected.
Figure 13:
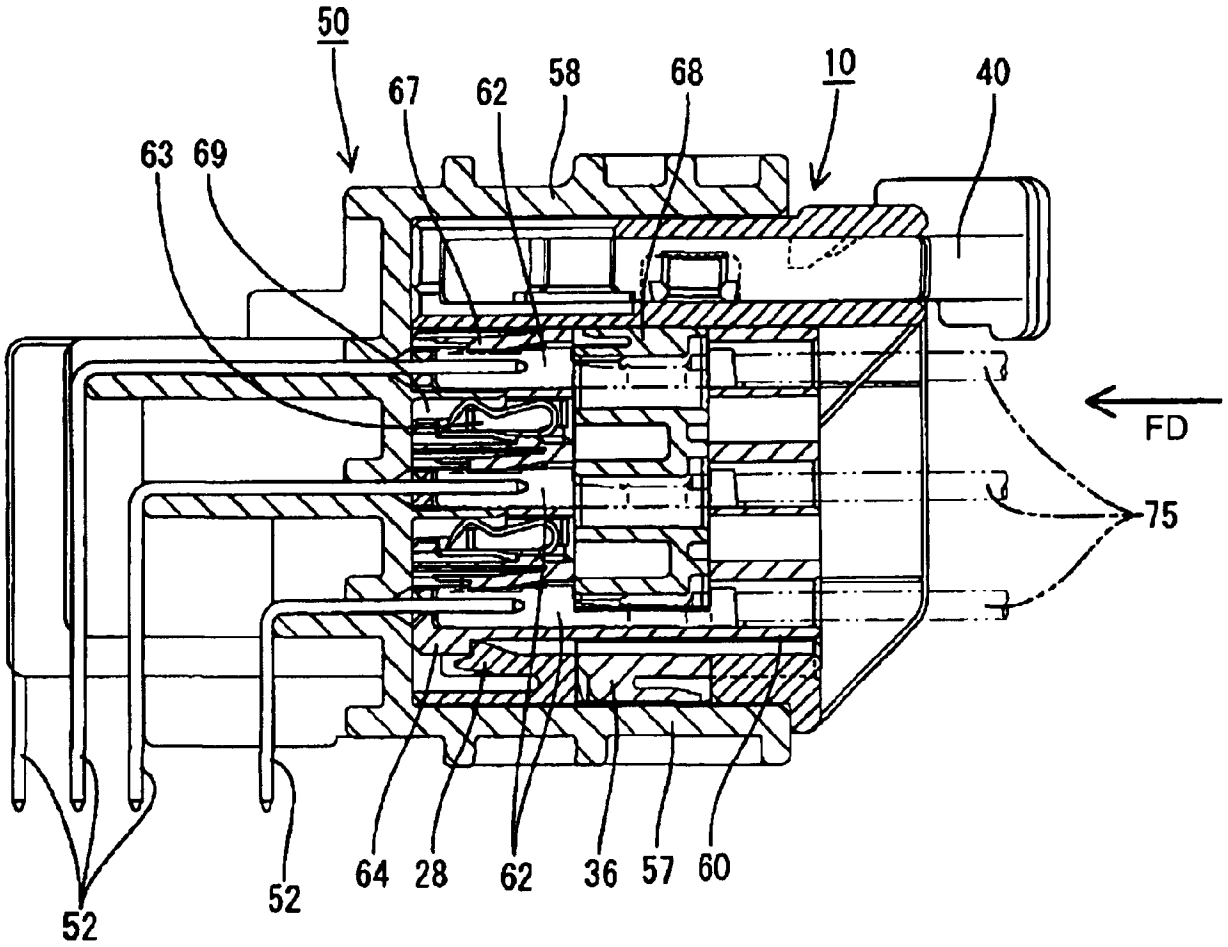
FIG. 13 is a longitudinal section showing a state where the first and second connectors are connected.

The second connector 50 has a housing 51 made e.g. of a synthetic resin and is formed with a forwardly open rectangular receptacle 53, as shown in FIGS. 11 and 12. The holder 11 of the first connector 10 can fit into the receptacle 53. Male terminal fittings 52 are bent at intermediate positions and are inserted through the back end surface of the receptacle 53 so that front parts of the male terminal fittings 52 project into the receptacle 53. Disengaging pieces 69 are formed at intervals between adjacent male terminal fittings 52.

Four guiding grooves 56 extend forward and back in a bottom wall 57 of the receptacle 53. Two of the guiding grooves 56 are formed at the left and right sides and two of the guiding grooves 56 are formed substantially in the middle part. On the other hand, substantially parallel guiding ribs 27 extend forward and back at positions on the bottom surface of the holder 11 substantially corresponding to the guiding grooves 56. Protruding pieces 35C which become substantially continuous with the guiding ribs 27 are formed on the outer surface of the housing retainer 34. The guiding ribs 27 and the protruding pieces 35 are both engageable with the guiding grooves 56 to guide a fitting operation of the holder 11 into the receptacle 53.

The guiding grooves 56 in the middle part have a trapezoidal, dovetail or undercut cross section. The guiding ribs 27 at the corresponding positions also a trapezoidal cross section for engagement with the dovetail grooves 56. It should be noted that the protruding pieces 35C have a cross section to fit in the dovetail grooves 56 while defining a clearance. The dovetail grooves 56 engage the guiding ribs 27 to prevent the receptacle 53 from deforming and bulging out as the holder 11 is mounted into the receptacle 53.

The cylindrical cam pin 54 and the unlocking rib 55 project down toward the inner space of the receptacle 53 from an upper wall 58 of the receptacle 53. The unlocking rib 55 is at a position corresponding to the insertion groove 19 of the holder 11 with respect to widthwise direction and extends from the front end of the receptacle 53 to the back end surface thereof.

Figure 14:
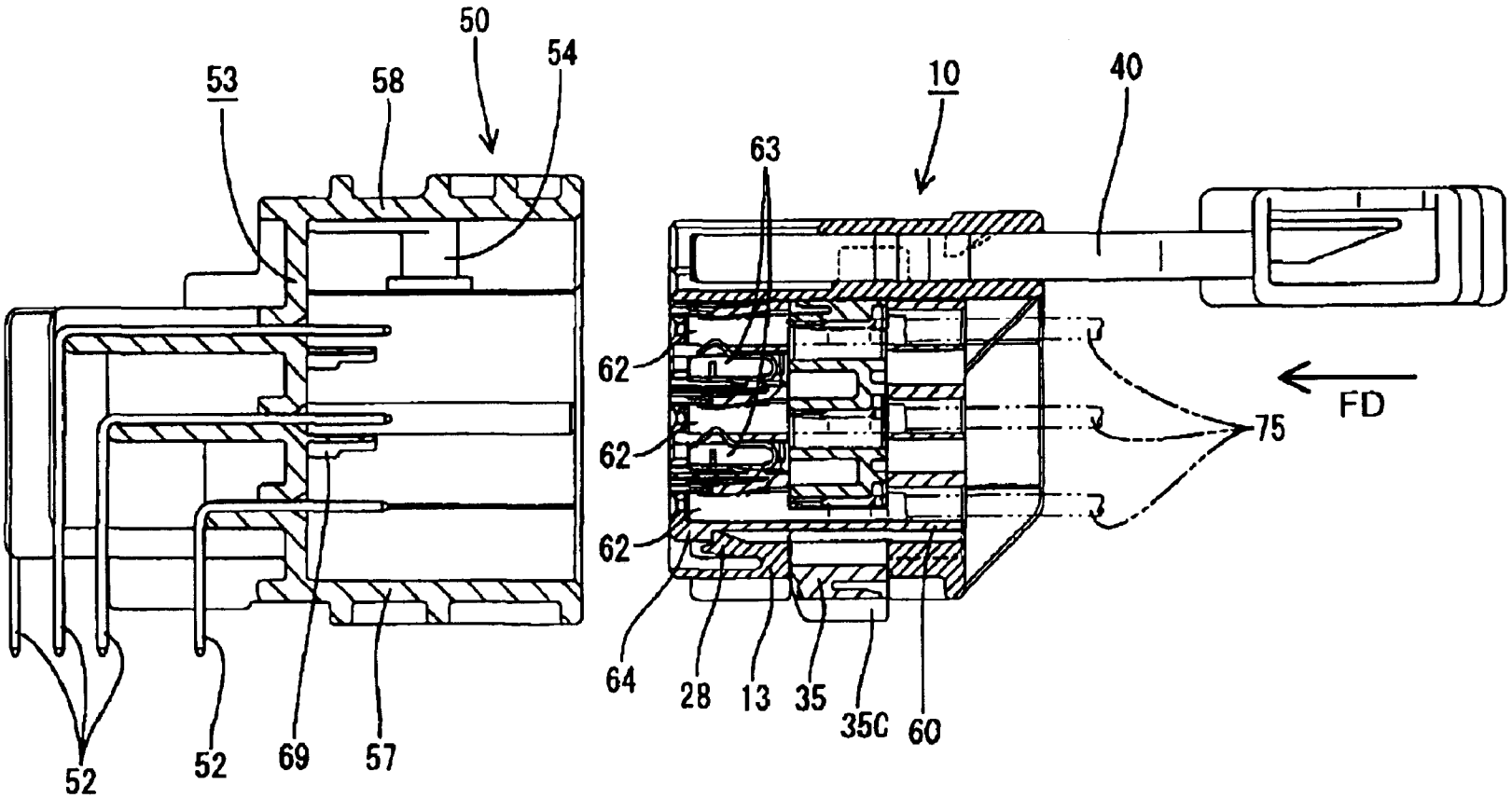
FIG. 14 is a longitudinal section showing a partly inserted housing retainer.
Figure 15:
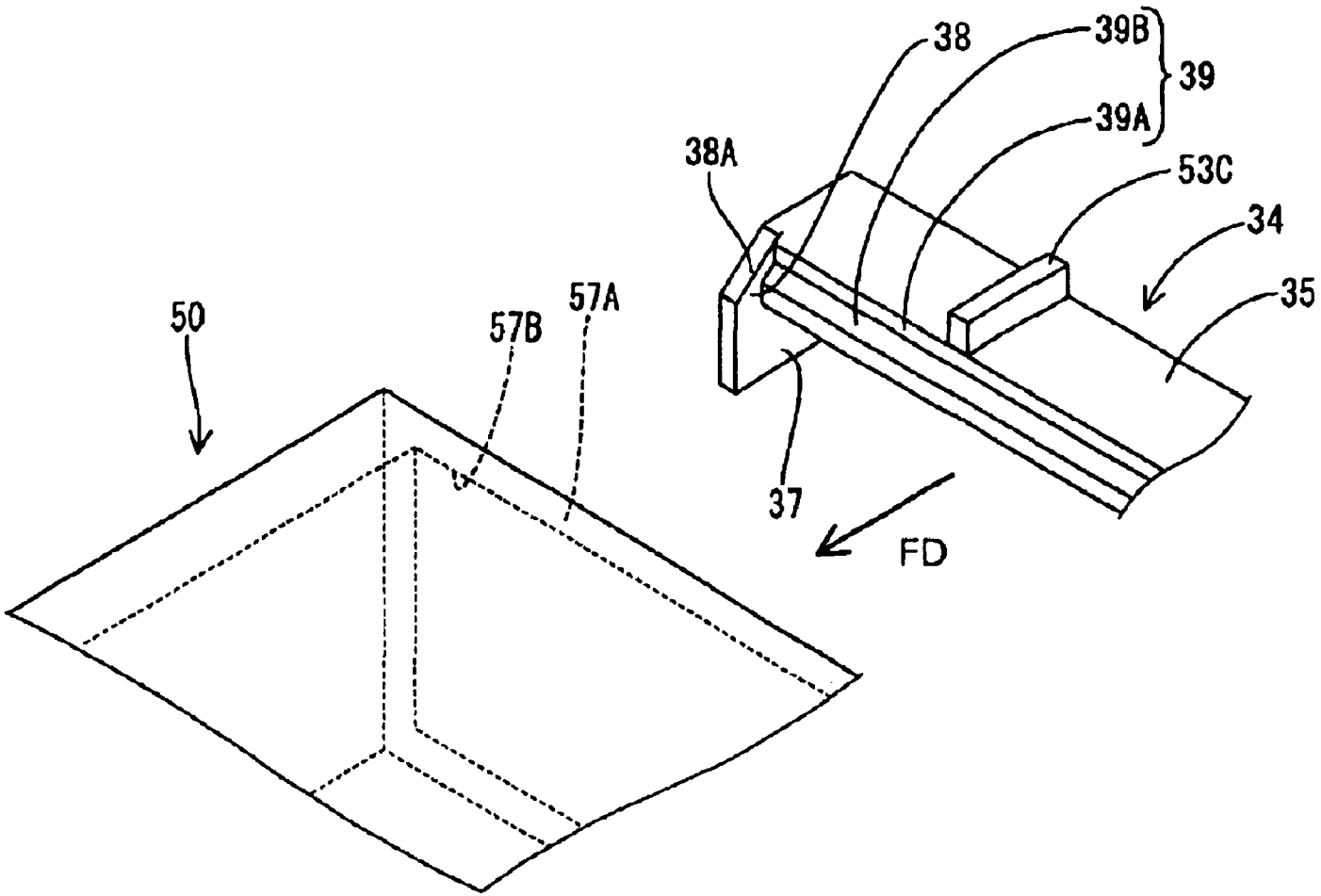
FIG. 15 is a perspective view of the holder and the housing retainer when viewed from below.
Figure 16:
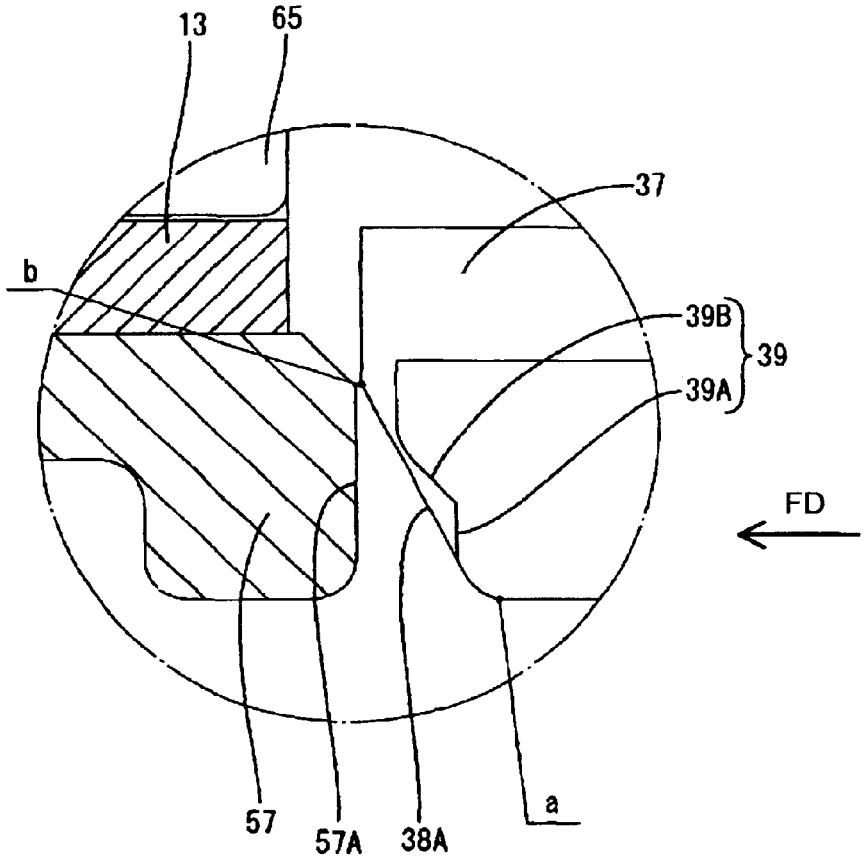
FIG. 16 is a section showing a positional relationship of an engaging surface and the housing retainer before the housing retainer is mounted.
Figure 17:
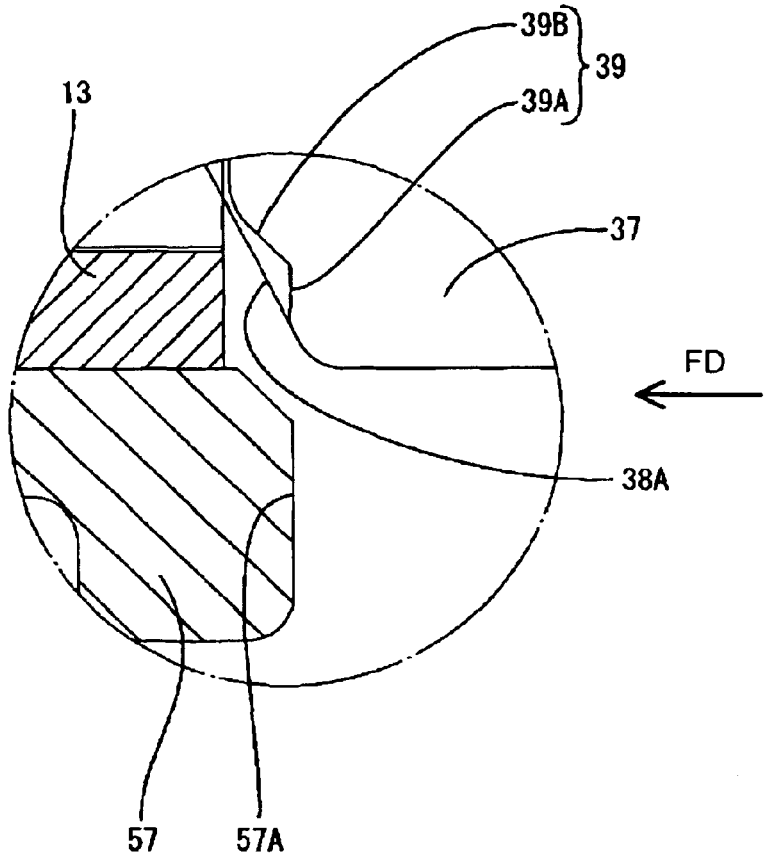
FIG. 17 is a section showing a state where the housing retainer is accommodated in an accommodating portion.

An extension 37 is formed at the leading end of each guiding wall 36 of the housing retainer 34 and is more forward than the main portion 35, as shown in FIG. 15. The lower sides of the extensions 37 project from the accommodating portion 22 and interfere with an opening edge 57B of a bottom wall 57 of the receptacle 53 when the housing retainer 34 is inserted only partly into the accommodating portion 22, as shown in FIGS. 14 and 16. Guides 38 are defined at the lower sides of the extensions 37 and have slanted surfaces 38A that slope up to front substantially continuous with the main portion 35. The slanted surfaces 38A slide in contact with the opening edge 57B of the receptacle 53 in the process of pushing the holder 11 into the receptacle 53, and can push the housing retainer 34 into the accommodating portion 22.

A restricting portion 39 is formed on the front end surface of the main portion 35 of the housing retainer 34 over substantially the entire length. The restricting portion 39 has a vertical wall 39A on the lower surface of the main portion 35 and an oblique wall 39B that is continuous with the vertical wall 39A. The vertical wall 39A is dimensioned to project from the accommodating portion 22 of the holder 11 when the housing retainer 34 is between the accommodated position and the projecting position, and faces an opening-end surface 57A in the bottom wall 57 of the receptacle 53 when the two connectors 10, 50 are connected in this state.

Figure 18:
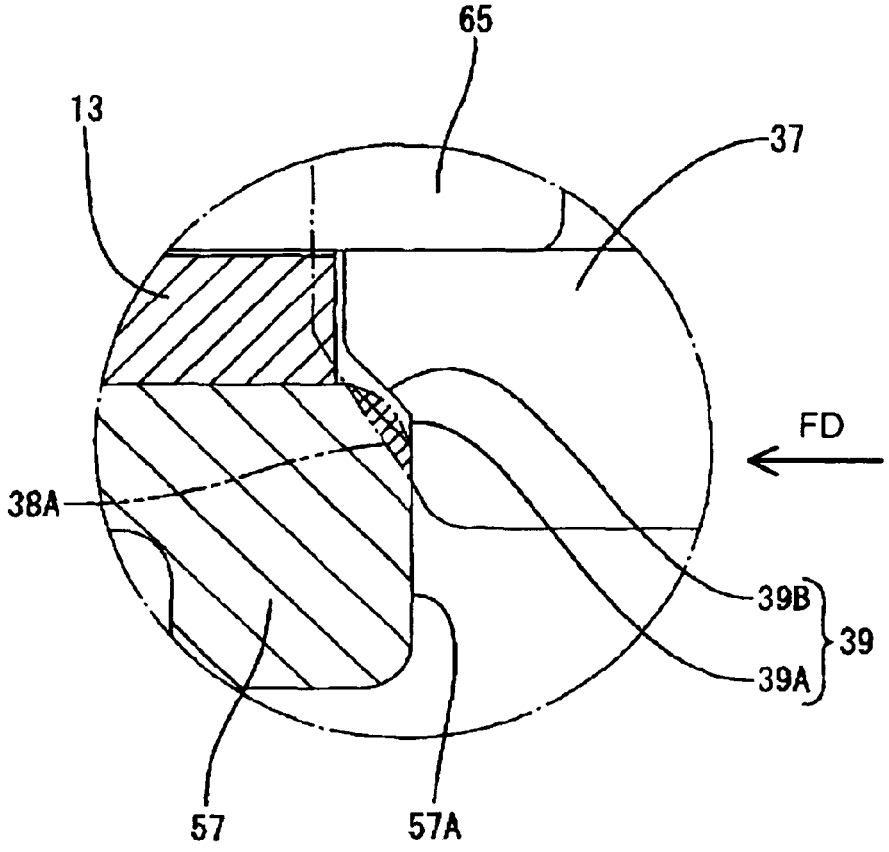
FIG. 18 is a section showing a state where a slanted surface is squashed.

The guide 38 may be squashed during the connecting operation due to an abnormality. However, the vertical wall 39A contacts the opening-end surface 57A of the receptacle 53 to hinder the connecting operation. A positional relationship of the vertical wall 39A with the slanted surface 38A along forward and backward directions is such that the vertical wall 39A is between a starting position "a" of the slanted surface 38A and an end position "b", as shown in FIG. 16. Additionally, the vertical wall 39A is at an inner side of the slanted surface 38A, i.e. above the slanted surface 38A in FIG. 16. Accordingly, as shown in FIG. 18, the vertical wall 39A is located immediately behind the slanted surface 38A and contacts the opening-end surface 57A of the receptacle 53 when the guide 38 is squashed. Thus, the connection of the two connectors 10, 50 can be hindered before they are completely connected when the slanted surfaces 38A of the holder 11 are squashed.

The first connector 10 is assembled by fitting the auxiliary connectors 60 into the respective mount spaces 21 of the holder 11. The housing retainer 34 is mounted at the projecting position to project from the holder 11 (see FIG. 7). The auxiliary connectors 60 then are mounted smoothly because the locking projections 35A of the housing retainer 34 are below the detection grooves 23.

The detection ribs 65 pass the main portion 35 of the housing retainer 34 when the auxiliary connector 60 reaches the proper depth (see FIG. 12). Thus, the detection ribs 65 are adjacent to and before the main portion 35, and the locking piece 28 of the holder 11 engages the lock projection 64 to the auxiliary connector 60 to lock the auxiliary connector 60. The housing retainer 34 then is pushed into the accommodating portion 22. As a result, the intermediate walls 35B of the main portion 35 enter the engaging grooves 20A of the partition walls 20 and the locking projections 35A of the main portion 35 enter the detection grooves 23. Consequently, the housing retainer 34 is accommodated in the accommodating portion 22 and the guiding recesses 14A to become substantially flush with the holder 11 as shown in FIG. 6. In this state, the locking projections 35A of the main portion 35 project through the detection grooves 23 and into the mount spaces 21 to engage the rear end surfaces of the detection ribs 65 from behind. The auxiliary connectors 60 are locked by the engagement with the locking projections 35A and with the locking pieces 28.

The first and second connectors 10, 50 then are opposed to each other and the holder 11 of the first connector 10 is fit lightly into the receptacle 53 of the second connector 50. The lever 40 of the holder 11 is locked at the initial position (see FIG. 8) in advance. Thus, the entrance of the cam groove 45 aligns with the escape groove 18 of the holder 11, so that the cam pin 54 can enter the cam groove 45. The unlocking rib 55 contacts the resilient locking piece 46 of the lever 40 and deforms the resilient locking piece 46 in the unlocking direction when the first and second connectors 10, 50 are connected further. As a result, the lever 40 is unlocked (see FIG. 9) and can rotate.

Rotation of the lever 40 creates a cam action between the cam pin 54 and the cam groove 45 that pulls the connectors 10, 50 towards one another. Additionally, the holder 11 is guided into the receptacle 53 by the engaged dovetail grooves 56 and guiding ribs 27. The housing retainer 34 previously was pushed into the accommodating portion 22. As a result, the main portion 35 of the housing retainer 34 does not project from the bottom wall 13 of the holder 11 and the connection of the connectors 10, 50 proceeds smoothly. The resilient locking piece 48 of the lever 40 engages the claw of the holder 11 when the lever 40 is rotated to the connection ending position (see FIG. 10). Thus, the two connectors 10, 50 reach their properly connected state and the male terminal fittings 52 and the female terminal fittings 62 are connected (see FIG. 13).

A situation may occur where the housing retainer 34 is not assembled properly. For example, FIG. 14 shows a situation where all of the auxiliary connectors 60 are mounted properly into the holder 11, but the housing retainer 34 is insufficiently inserted into the accommodating portion 22. Thus, the slanted surfaces 38A of the housing retainer 34 projects from the bottom surface of the holder 11. Accordingly, the slanted surfaces 38A of the housing retainer 34 interfere with the opening edge 57B of the receptacle 53 at an intermediate stage of the connection, as shown in FIG. 16. Thereafter, the slanted surfaces 38A slide in contact with the opening edge 57B as the connection of the two connectors 10, 50 proceeds (see FIG. 17). Thus, the housing retainer 34 is pushed up by the slanted surfaces 38A and the housing retainer 34 is accommodated into the accommodating portion 22 when the opening edge 57B of the receptacle 53 passes the corresponding slanted surfaces 38A. The housing retainer 34 is corrected to the accommodated position in this way. As a result, the housing retainer 34 locks the auxiliary connectors 60 and the connectors 10, 50 reach their properly connected state.

Figure 19:
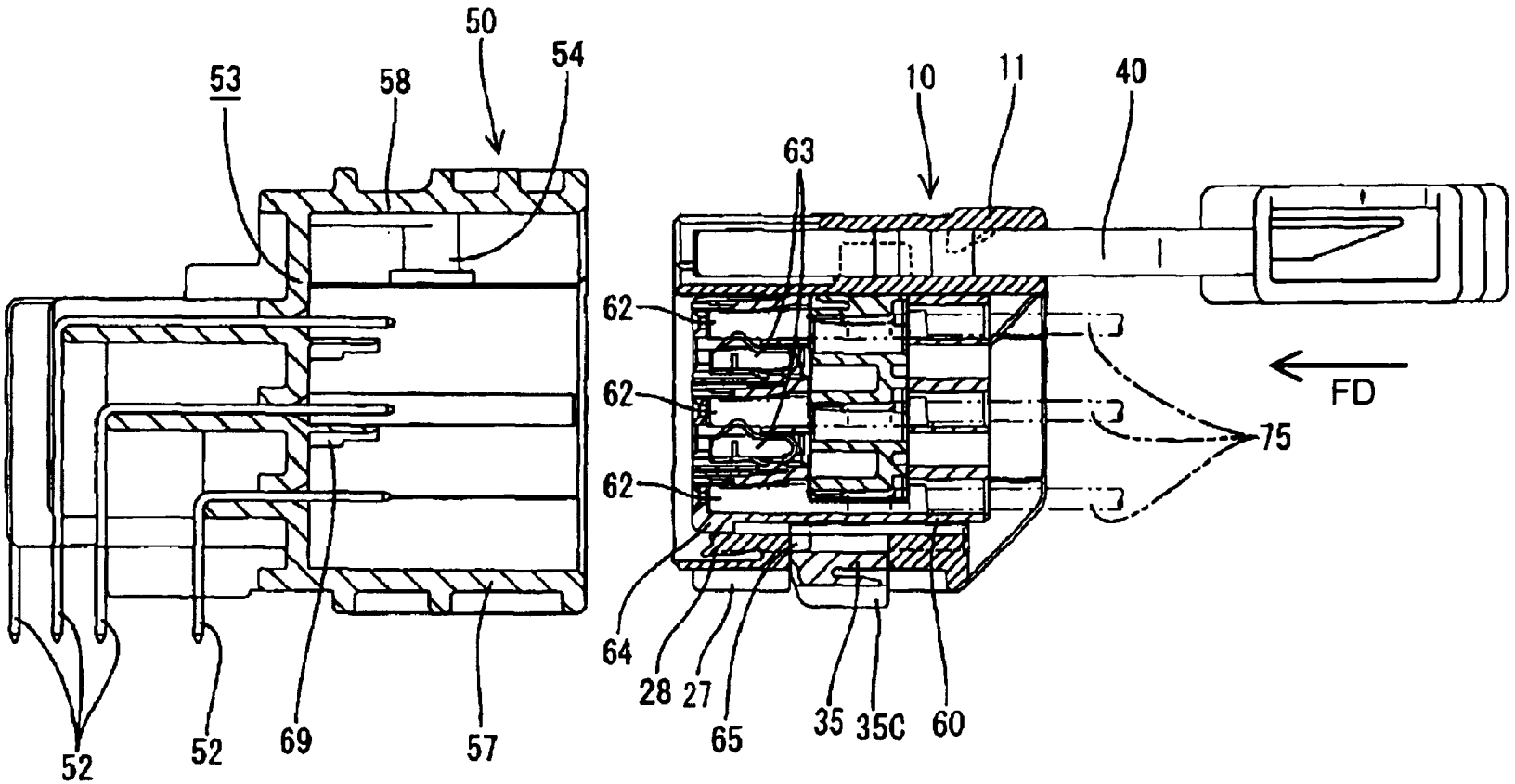
FIG. 19 is a longitudinal section showing the partly inserted state of the housing retainer (the auxiliary connectors are also partly inserted).
Figure 20:
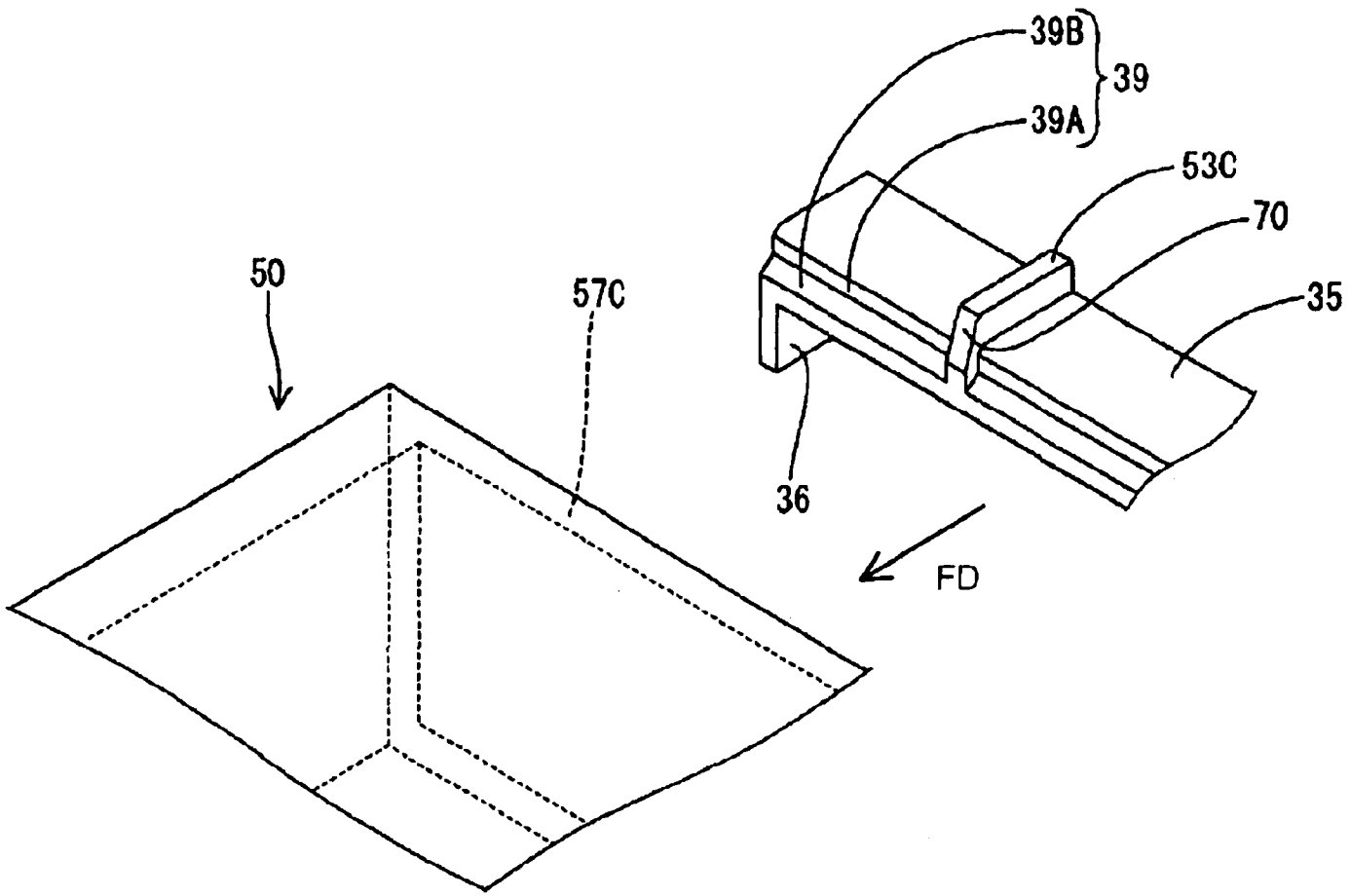
FIG. 20 is a perspective view when a slanted surface is formed on a protruding piece.

The housing retainer 34 also will project from the accommodating portion 22 if the auxiliary connector 60 is not inserted to the properly or sufficiently into the holder 11, as shown in FIG. 19. In this case, the housing retainer 34 cannot be pushed into the accommodating portion 22 due to the interference of the detection ribs 65 of the auxiliary connector 60 and the housing retainer 34 in the accommodating portion 22. As a result, the housing retainer 34 is left partly inserted.

An attempt to connect the two connectors 10, 50 in this state will cause the slanted surfaces 38A to abut the opening edge 57B of the receptacle 53. However, movement of the housing retainer 34 into the accommodating portion 22 is prevented. The guiding portions 38 are not very thick. Thus, parts of the guiding portions 38 that contact the opening edge 57B (hatched part in FIG. 18) yield to the pushing force exerted during the connecting operation and may be squashed or otherwise deformed. However, the vertical wall 39A comes into surface contact with the opening-end surface 57A of the receptacle 53 and receives the pushing force after the slanted surfaces 38A are squashed. Accordingly, the holder 11 cannot be fit any further into the receptacle 53.

Such a squashing phenomenon is likely to occur in connectors having many terminals due to friction between the terminals during connection. This friction increases in proportion to the number of terminals, thereby requiring a larger force for connection. Accordingly, a large pushing force acts on the slanted surfaces 38A during the assembling. Further, in this embodiment, the slanted surfaces 38A are particularly easy to squash because the holder 11 is prevented from undergoing a bulging deformation due to the engagement of the guiding ribs 27 and the dovetail grooves 56.

As described above, the action of the sliding surfaces will push the housing retainer 34 automatically into the accommodating portion 22 as the two connectors 10, 50 are connected if the auxiliary connectors 60 are inserted substantially to the proper depth in the holder 11. On the other hand, the slanted surfaces 38A are likely to be squashed during the connecting operation of the two connectors 10, 50 if one of the auxiliary connectors 60 is not inserted to the proper depth. However, the vertical wall 39A comes substantially into surface contact with the opening-end surface 57A of the receptacle 53 to hinder the connection of the two connectors 10, 50. The presence of the improperly mounted auxiliary connector 60 can be detected by this hindrance to the connecting operation. Therefore, an operator conducting the assembling operation can detect an abnormality to exclude an erroneous assembling and the reliability of the connector can be improved.

Figure 21:
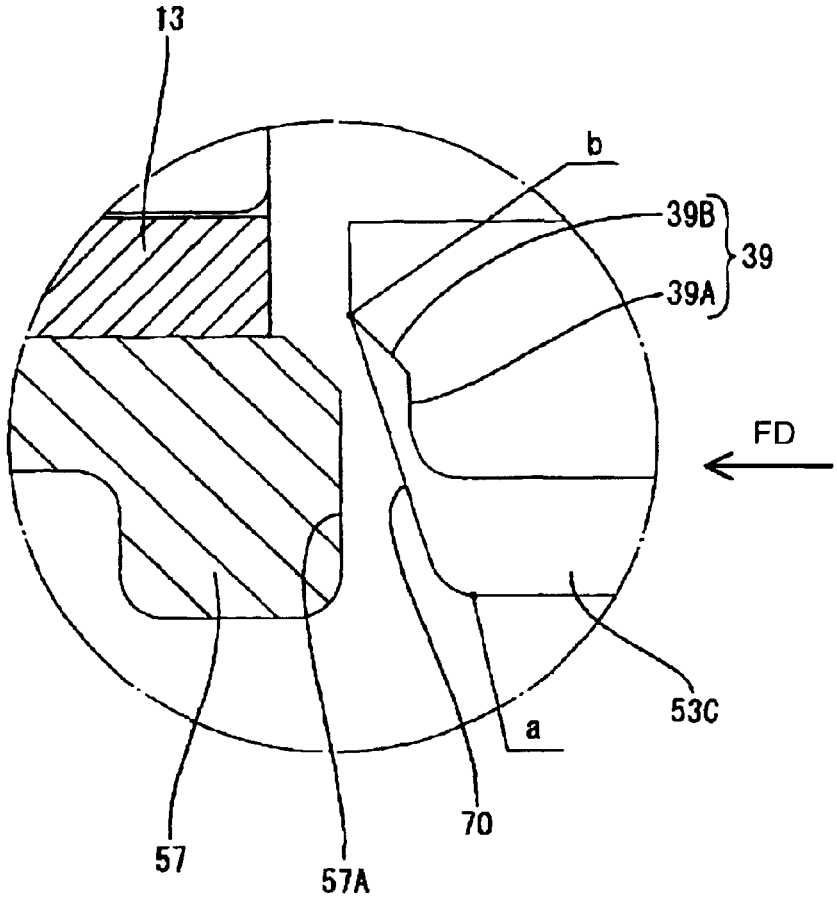
FIG. 21 is a section showing a positional relationship of the engaging surface and the housing retainer before the housing retainer is mounted.
Figure 22:
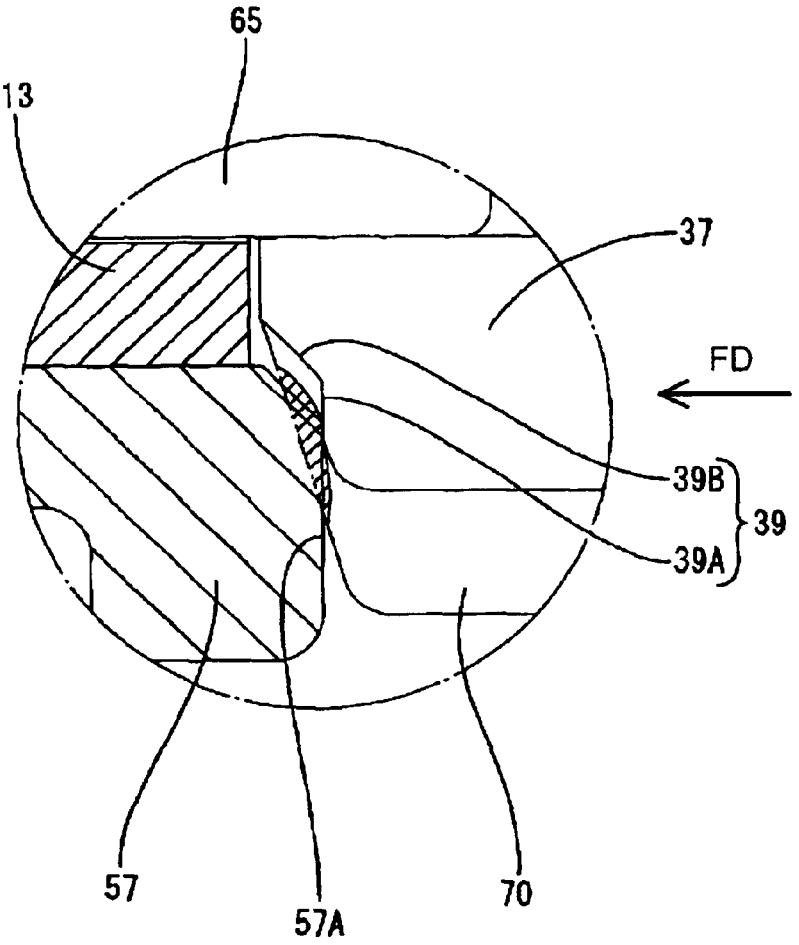
FIG. 22 is a section showing a state where the slanted surface is squashed.

The guiding portions 38 are formed on the extending portions 37 of the guiding walls 36, which are existing structural parts. Thus, the shape of the housing retainer 34 is relatively uncomplicated. The guiding portions 38 also can be provided on other existing structures. FIG. 21 shows a case where no slanted surfaces are formed on the guiding walls 36, but slanted surfaces 70 are formed on the leading ends of the protruding pieces 35C. The aforementioned effects can be obtained in this case as well.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The housing retainer 34 has no a locking construction for simultaneously preventing movements of the housing retainer 34 in both pushing direction and/or withdrawing direction at the accommodated position and the projecting position in the foregoing embodiment. However, the invention may also be applicable to a housing retainer with such a locking construction to simultaneously prevent movements in both directions.

The described retainer is applied to the housing retainer 34 in the foregoing embodiment, but it may be applied to the terminal retainer 68. Specifically, the invention is applicable to an integral type connector instead of a divided type connector, and/or the guiding portions 38 and the restricting potion 39 may be provided on the terminal retainer for locking the terminals.

What is claimed is:

1. A connector, comprising:

an engageable element that is fittable into a receptacle on a mating connector and into which at least one terminal fitting is mountable, and a retainer mountable into an accommodating portion, wherein:

the retainer and the engageable element are configured for insertion into the receptacle when the retainer is accommodated properly in the accommodating portion, whereas the retainer contacts an opening edge of the receptacle when the retainer is left improperly inserted into the accommodating portion, and the retainer includes at least one guide with a slanted surface aligned for sliding contact with the opening edge of the receptacle to guide the retainer into the accommodating portion during insertion into the receptacle, and at least one restriction formed with a wall to substantially face an opening-end surface of the receptacle.

2. The connector of claim 1, wherein the wall is formed between a starting end and a terminus end of the slanted surface with respect to the fitting direction of the engageable element and inwardly from the slanted surfaces.

3. The connector of claim 1, wherein the vertical wall prevents the fitting operation by contacting the opening-end surface of the receptacle when the guide is squashed during the fitting operation into the receptacle.

4. The connector of claim 1, wherein the accommodating portion is formed by recessing a side surface of the engageable element.

5. A connector assembly comprising the connector of claim 1 and a mating connector connectable therewith.

6. The connector of claim 1, wherein the engageable element includes a plurality of auxiliary connectors and a holder into which the auxiliary connectors are mountable and in one side surface of which the accommodating portion is formed.

7. The connector of claim 6, wherein the retainer has guiding walls at opposite widthwise sides of a main portion thereof for sliding contact with side surfaces of the holder, the retainer having a U-shape and crossing over the holder so that the retainer locks the auxiliary connectors inserted to a proper depth in the holder when the retainer is properly accommodated into the accommodating portion.

8. The connector of claim 7, each guiding wall has an extending portion extending toward the receptacle and projecting outward from the accommodating portion with the retainer left only partly inserted, and the guiding portion is formed on the extending portion.

9. The connector of claim 8, wherein at least one guiding groove is formed in an inner surface of the receptacle of the mating connector and extends substantially in the fitting direction, at least one guiding rib projecting from a side surface of the holder for engagement with guiding groove.

10. The connector of claim 9, wherein the retainer locks the auxiliary connectors inserted to a proper depth in the holder when the retainer is accommodated properly into the accommodating portion, and at least one protruding piece on an outer surface of the retainer as to become substantially flush with the guiding rib, the guiding portion being formed at a leading end of the protruding piece with respect to the fitting direction.

* * * * *